US010576759B2

(12) United States Patent
Kobayashi

(10) Patent No.: US 10,576,759 B2
(45) Date of Patent: Mar. 3, 2020

(54) ROLL BODY SUPPORTING DEVICE AND PRINTING APPARATUS

(71) Applicant: SEIKO EPSON CORPORATION, Tokyo (JP)

(72) Inventor: Masaki Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/006,416

(22) Filed: Jun. 12, 2018

(65) Prior Publication Data

US 2018/0361763 A1 Dec. 20, 2018

(30) Foreign Application Priority Data

Jun. 14, 2017 (JP) ..... 2017-116546

(51) Int. Cl.
*B41J 15/04* (2006.01)
*B41J 11/04* (2006.01)
*B41J 15/02* (2006.01)

(52) U.S. Cl.
CPC ..... *B41J 11/04* (2013.01); *B41J 15/02* (2013.01); *B41J 15/042* (2013.01)

(58) Field of Classification Search
CPC ..... B41J 11/04; B41J 15/02; B41J 15/042
See application file for complete search history.

(56) References Cited

U.S. PATENT DOCUMENTS 2,261,740 A * 11/1941 Makarius ..... B41N 7/06 492/7
4,477,954 A * 10/1984 Molinatto ..... F16C 13/024 492/6
2009/0226235 A1* 9/2009 Kobayashi ..... B41J 15/04 400/614
2009/0297777 A1* 12/2009 Sano ..... B29C 43/222 428/156
2014/0186086 A1* 7/2014 Yato ..... B41J 15/042 400/611
2016/0152057 A1* 6/2016 Maekawa ..... B65H 16/06 347/213

FOREIGN PATENT DOCUMENTS

JP 2013-047139 A 3/2013
JP 2017-030157 A 2/2017
JP 2017-043449 A 3/2017
WO WO2017-017951 2/2017
WO WO2017-033460 3/2017

* cited by examiner

*Primary Examiner* — Yaovi M Ameh
(74) *Attorney, Agent, or Firm* — Workman Nydegger

(57) ABSTRACT

A roll body supporting device that rotatably supports a roll body includes a shaft member inserted into a core of the roll body, a shaft outer circumference member fixed to an outer circumference of the shaft member, a core support member that is inwardly in contact with and fits on the core, and a rotation support section that connects the shaft outer circumference member to the core support member and supports the core support member in a manner to be rotatable about the shaft member relative to the shaft outer circumference member.

13 Claims, 9 Drawing Sheets

ROLL BODY SUPPORTING DEVICE AND PRINTING APPARATUS

CROSS-REFERENCE TO RELATED APPLICATIONS

The present application claims priority to Japanese Patent Application No. 2017-116546, filed Jun. 14, 2017, which is hereby incorporated by reference in its entirety.

BACKGROUND

1. Technical Field

Embodiments of the present invention relate to a roll body supporting device and a printing apparatus that includes the roll body supporting device.

2. Related Art

As an example of a roll body supporting device, JP-A-2013-47139 discloses a roll medium feeding apparatus that includes a roll holder. The roll holder has fitting sections configured to fit in core openings of the roll body to thereby support both ends of the roll body in a manner that allows the roll medium to be fed out. The fitting section of the roll holder is formed in a shape that can smoothly fit in roll bodies having different sizes.

However, because the roll medium feeding apparatus disclosed in JP-A-2013-47139 is configured to support both ends of the roll body by the fitting sections fitting in the core openings of the roll body, it is difficult to support a roll body whose width is large. More particularly, when supporting a roll body having a large width, a center part of the roll body will sag due to the weight of the roll body itself. This may disturb smooth feeding-out and taking-up of the roll body. Further, in the apparatus for processing the roll body, when a plurality of roll bodies are set at one time and individually fed out, the roll medium feeding apparatus disclosed in JP-A-2013-47139 has a problem in that the roll holder for supporting both ends of the roll bodies needs to be provided for each of the roll bodies. This may increase in size of the apparatus.

SUMMARY

An advantage of some aspects of the invention can be implemented as the following application examples or forms.

Application Example 1

According to the present application example, a roll body supporting device that rotatably supports a roll body is disclosed. The roll body supporting device may include a shaft member inserted into a core of the roll body, a shaft outer circumference member fixed to an outer circumference of the shaft member, a core support member that is inwardly in contact with and fits on the core, and a rotation support section that connects the shaft outer circumference member to the core support member and that supports the core support member such that the core support member is rotatable about the shaft member relative to the shaft outer circumference member.

In this application example, the roll body is rotatably supported by the shaft outer circumference member, the core support member, and the rotation support section about the base shaft, which is the shaft member inserted into the core of the roll body. That is, a roll material that constitutes the roll body is supported in a manner that can be fed out and taken up. Further, the shaft outer circumference member, the core support member, the rotation support section, and the like can be disposed inside the core of the roll body about the base shaft, which is the shaft member. Accordingly, even if the roll body has a large width, a portion of the roll body that would sag due to the weight of the roll body itself can be supported from inside the core. As a result, in supporting the roll body having a large width, the roll body is prevented from sagging, which allows for smooth feeding-out and taking-up of the roll body.

Application Example 2

In the roll body supporting device according to the above application example, a fixation position of the shaft outer circumference member to the shaft member may be variable.

In this application example, the shaft outer circumference member, the core support member, the rotation support section, and the like can be disposed inside the core of the roll body about the base shaft, which is the shaft member, and a fixation position of the shaft outer circumference member, which determines their positions, relative to the shaft member is variable. Accordingly, the roll body supporting devices can be provided at appropriate positions for supporting various roll bodies having different sizes (widths). For example, for the roll body having a large width, a plurality of these components can be disposed on both end regions of the roll body and inside the core at substantially equal intervals in the width direction of the core. As a result, in supporting the roll body having a large width, the roll body is prevented from sagging, which allows for smooth feeding-out and taking-up of the roll body.

Application Example 3

In the roll body supporting device according to the above application example, a rotation driving section that rotates the core support member about the shaft member relative to the shaft outer circumference member may be provided.

In this application example, since the rotation driving section that rotates the core support member is provided, feeding-out and taking-up of the roll body can be more smoothly performed.

Application Example 4

In the roll body supporting device according to the above application example, the shaft member may be a square rod.

In this application example, because the rotation support section that rotatably supports the core support member about the shaft member relative to the shaft outer circumference member is provided, the shaft member does not need to be rotatable. Accordingly, the shaft member may be provided as a square rod without problem. By providing the shaft member as a square rod, the shaft member can be fixedly supported in a more simplified configuration.

Application Example 5

In the roll body supporting device according to the above application example, a shaft supporting section that supports the shaft member may be configured to include a V block that fixedly supports the shaft member.

In this application example, the shaft member is formed of a square rod, and the shaft supporting section that fixedly supports the shaft member includes the V block that fixedly supports the shaft member. In the configuration in which the shaft member (square rod) is supported by the V block from vertically under the shaft member, the shaft member is fixed (positioned) to the V block due to the weight of the components including the roll body (the shaft member, the shaft outer circumference member, the core support member, and the rotation support section). Accordingly, the configuration for fixedly supporting the shaft member can be achieved in a more simplified manner, for example, by simply placing the shaft member (square rod) on the V block. For example, a V-shaped cut out may be provided in the support block and two sides of the shaft may rest in the V-shaped cut out.

Application Example 6

In the roll body supporting device according to the above application example, at least five support mechanisms, each including the shaft outer circumference member, the core support member, and the rotation support section, may be provided for each the shaft member.

In this application example, by providing 5 sets of the support mechanisms which include the shaft outer circumference member, the core support member, and the rotation support section for each shaft member, two roll bodies can be attached on one shaft member in a convenient manner. Further, the roll bodies may be supported so as to independently rotate relative to the shaft member. Accordingly, even if the roll bodies have different roll diameters, the roll bodies can rotate at the same feeding-out rate or taking-up rate without problem since they can rotate at different rotation rates relative to the same one shaft member. Further, when two roll bodies are set on one shaft member, 5 sets or more of the support mechanisms can be provided. Accordingly, for at least one of the roll bodies, the support mechanisms can be provided at positions that support the roll bodies from inside the core about the base shaft, which is the shaft member, in the region other than both end regions of the roll body. Accordingly, even if one of the roll bodies has a large width, the roll body is prevented from sagging, which allows for smooth feeding-out and taking-up of the roll body.

Application Example 7

According to the present application example, a printing apparatus may include the roll body supporting device according to the above application examples that rotatably supports a roll body made of a print medium wound in a roll shape, a transport unit that transports the print medium, and a print section that performs printing on the print medium.

In this application example, the roll body supporting device according to the above application examples is provided in the printing apparatus that performs printing on the print medium wound in a roll shape. Accordingly, the roll body can be smoothly fed out and taken up without sagging even if the roll body has a large width. Further, since a plurality of roll bodies can be set on one shaft member, a printing apparatus that performs printing on a plurality of roll bodies can be provided with a more compact configuration and a comparatively smaller size.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Figure 1:
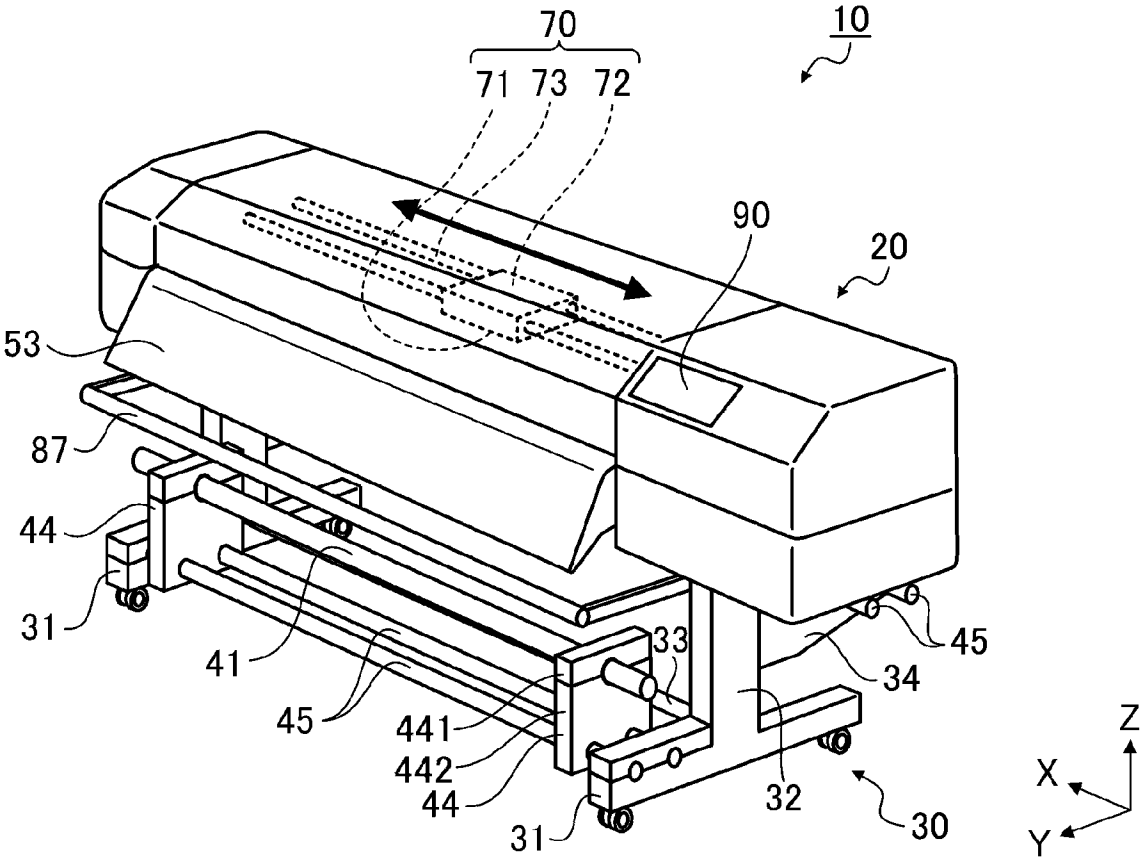
FIG. 1 is a perspective view which illustrates an example configuration of a printing apparatus according to Embodiment 1.

With reference to the drawings, an embodiment by which the present invention is embodied will be described. The following describes an embodiment of the present invention, and should not be construed as limiting the present invention. For ease of description, the drawings may not be illustrated to scale. In the coordinate systems indicated in the drawings, a Z axis direction represents the up-down direction, the +Z direction represents the upward direction, a Y axis direction represents the front-back direction, the +Y direction represents the forward direction, an X axis direction represents the left-right direction, the +X direction represents the left direction, and an X-Y plane represents the horizontal plane.

Embodiment 1

Figure 2:
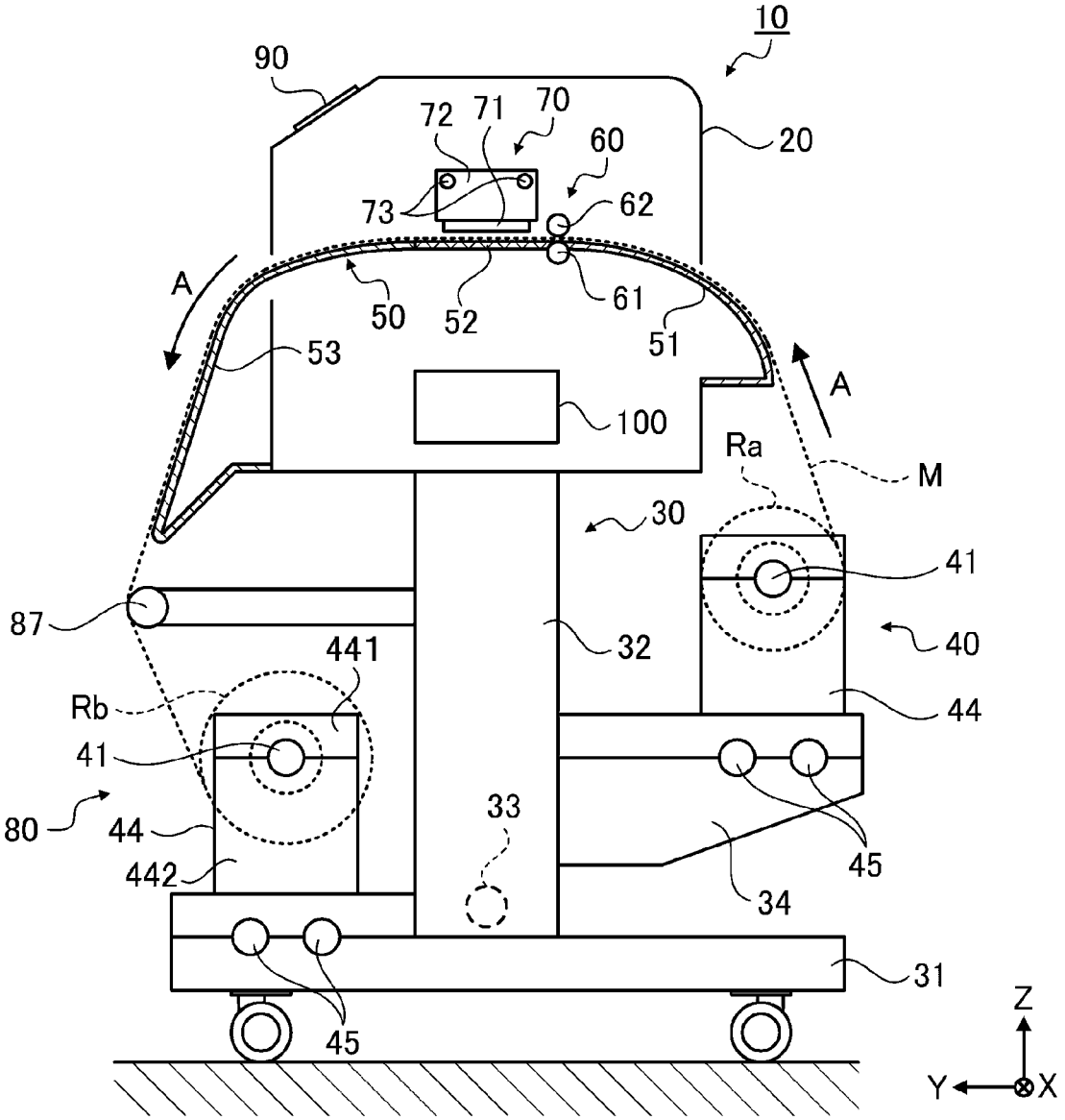
FIG. 2 is a conceptual view of the printing apparatus as viewed from the side surface.

FIG. 1 is a perspective view that illustrates a configuration of a printing apparatus 10 according to Embodiment 1, and FIG. 2 is a conceptual view of the printing apparatus 10 as viewed from the side surface. The printing apparatus 10 may be an ink jet printer that performs printing of a desired image on an elongated roll paper M, which is supplied as a "print medium" in a roll-shape (roll body). As shown in FIG. 2, the printing apparatus 10 includes a feed-out section 40 that feeds out the roll paper M wound around a roll body Ra in a transport direction A of the roll paper M, a medium support section 50 that supports the roll paper M fed out from the roll body Ra, a transport unit 60 that applies a transport force to transport the roll paper M, a print section 70 that performs printing on the roll paper M, and a take-up section 80 that takes up the roll paper M around the roll body Rb after printing is completed. Further, the printing apparatus 10 includes an operation section 90 which is operated by a user (an operator of the printing apparatus 10), and a control unit 100 that integrally controls the printing apparatus 10. These components are configured as one apparatus composed of a box-shaped housing 20 and a housing support section 30 that supports the housing 20. The feed-out section 40 and the take-up section 80 are examples of a "roll body supporting device" in the present application.

As shown in FIGS. 1 and 2, the housing support section 30 includes first legs 31. The first legs 31 extend or have a longitudinal direction in the Y axis direction. The housing support section 30 includes second legs 32 that extend upward from the first legs 31, a connection shaft 33 that connects the second legs 32 in the X axis direction, and extended sections 34 which extend rearward (in the −Y direction) from the second legs 32. The first legs 31 and the second legs 32 are respectively disposed in pairs in the X axis direction. One pair is on one side of the apparatus 10 and another pair is on the other side of the apparatus 10. Further, while the lower ends of the second legs 32 are connected to the first legs 31, the upper ends of the second legs 32 that are opposite to the lower ends are connected to the housing 20.

Figure 3:
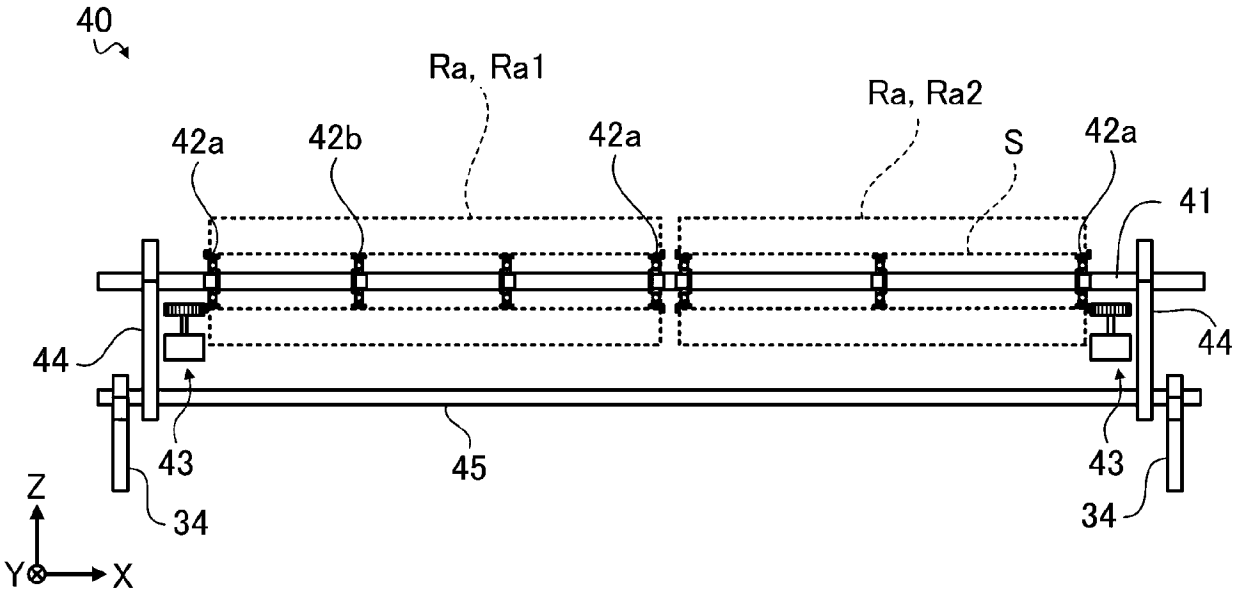
FIG. 3 is a rear view which illustrates a configuration of a feed-out section (roll body supporting device) according to Embodiment 1.

FIG. 3 is a rear view of the apparatus 10 and illustrates a configuration of the feed-out section 40 as viewed from the rear side of the printing apparatus 10 (−Y side). As shown in FIGS. 2 and 3, the feed-out section 40 is supported by the extended section 34 of the housing support section 30 at a position on the lower rear side of the housing 20, which is a position upstream relative to the transport unit 60 and the print section 70 in the transport path of the roll paper M. The feed-out section 40 may include a shaft member 41, a support mechanism 42 (support mechanisms 42*a* and 42*b*), rotation driving sections 43, shaft supporting sections 44, a guide shaft 45, and the like.

The shaft member 41 may be a round rod inserted into a core S of each of a plurality of roll bodies Ra (two in the example shown in FIG. 3, i.e., roll bodies Ra1 and Ra2), which are made of the roll papers M wound into a tubular shape. The roll body Ra is rotatably supported by the support mechanism 42 (support mechanisms 42*a* and 42*b*) with the shaft member 41 as a base shaft. This arrangement allows the roll paper M that constitutes the roll body Ra to be fed out or unrolled).

Figure 4:
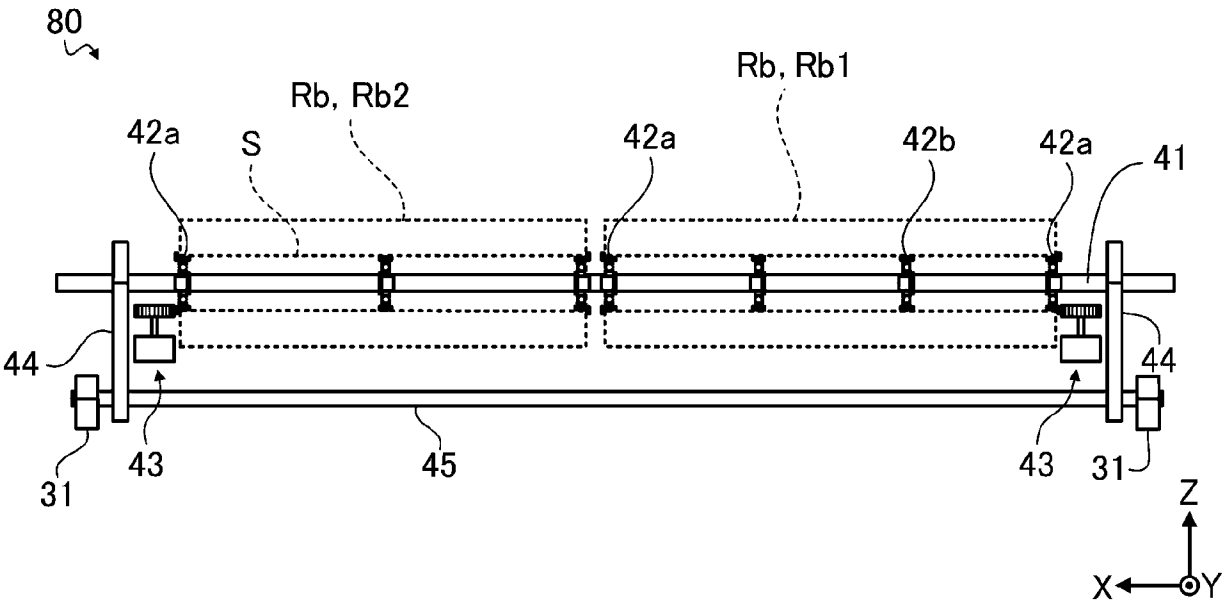
FIG. 4 is a front view which illustrates a configuration of a take-up section (roll body supporting device) according to Embodiment 1.

FIG. 4 is a front view of the apparatus 10 and illustrates a configuration of the take-up section 80 as viewed from the front side of the printing apparatus 10 (+Y side). As shown in FIGS. 2 and 4, the take-up section 80 is supported by the first legs 31 of the housing support section 30 at a position on the lower front side of the housing 20, which is a position downstream relative to the transport unit 60 and the print section 70 in the transport path of the roll paper M. The take-up section 80, as with the feed-out section 40, may include the shaft member 41, the support mechanism 42 (support mechanisms 42*a* and 42*b*), the rotation driving sections 43, the shaft supporting sections 44, the guide shaft 45, and the like. After the roll paper M is fed out from the roll bodies Ra1 and Ra2 and printing is performed thereon, the take-up section 80 takes up the roll paper M into a tubular shape as the roll bodies Rb1 and Rb2. Thus, the roll paper M is unrolled from the feed-out section, printed on, and rolled up by the take-up section 80.

Figure 5:
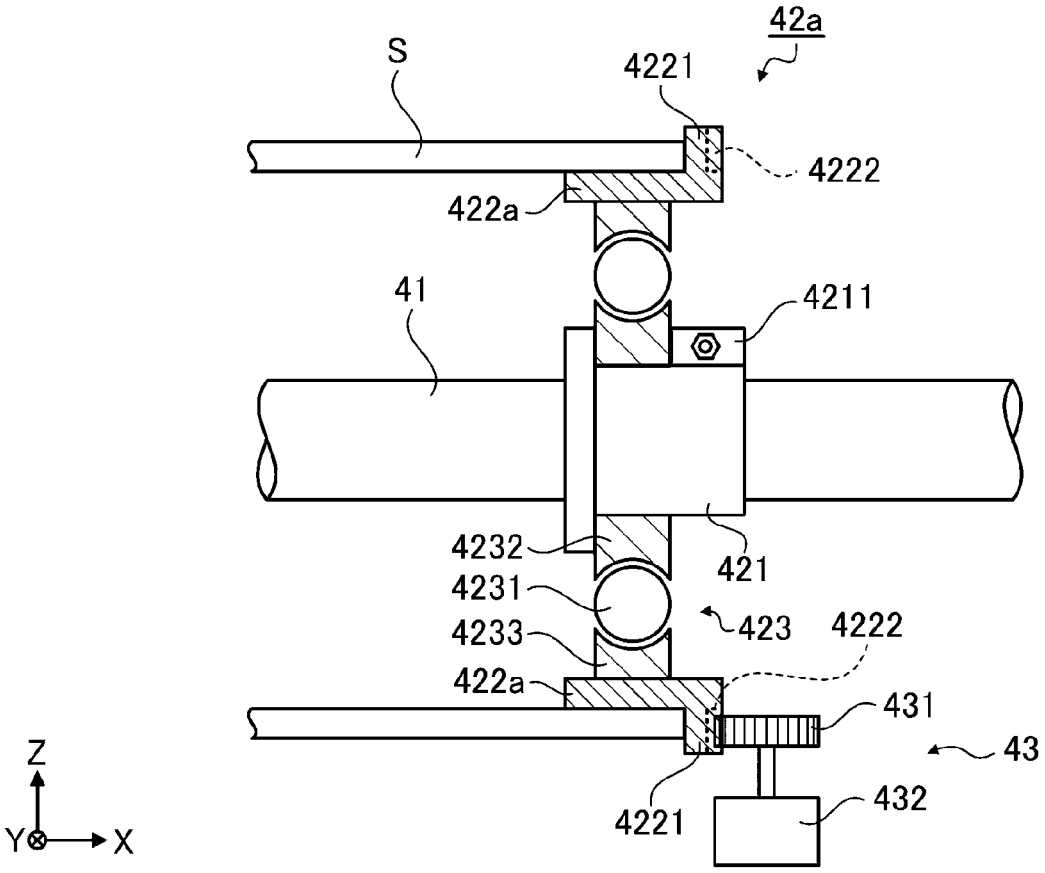
FIG. 5 is a cross-sectional view which illustrates a configuration of a support mechanism.
Figure 6:
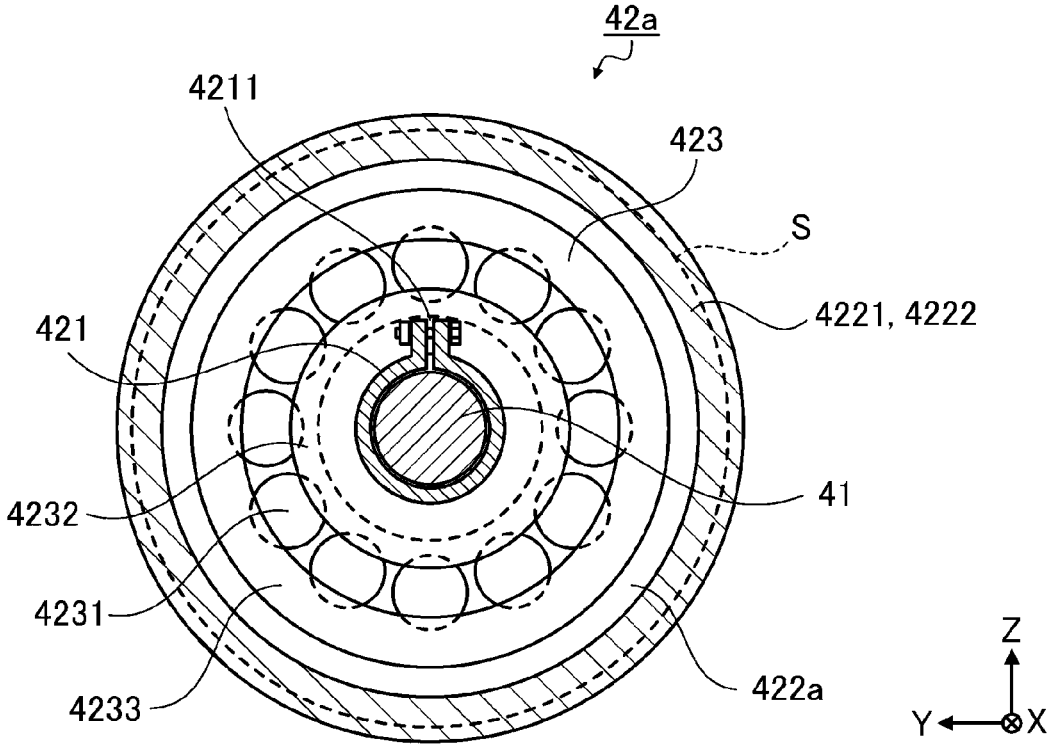
FIG. 6 is a plan view which illustrates a configuration of the support mechanism.

FIG. 5 is a cross-sectional view that illustrates a configuration of the support mechanism 42*a*, and FIG. 6 is a plan view thereof. FIG. 5 shows the support mechanism 42*a* as viewed from the −Y side. The support mechanism 42*a* is mounted on the core S of the roll body Ra2 from the +X side at the end of the roll body Ra2 on the +X side (see FIG. 3). The other end of the roll body is similarly associated with a support mechanism. Further, FIG. 6 shows the support mechanism 42*a* as viewed from the +X side.

The support mechanisms 42*a* are provided as a pair and serve as a support mechanism that supports both ends of the roll body Ra—one on each end of the roll body Ra. The support mechanism 42*a* may include a shaft outer circumference member 421, a core supporting member 422*a*, a rotation support section 423, and the like. The support mechanisms 42 (support mechanisms 42*a* and 42*b*) will be described below with respect to the core S of the roll body Ra. Because the core S is common to both the roll body Ra and the roll body Rb (each may have a core or they may share the same core), the same description applies to the configuration and function of the support mechanisms 42 (support mechanisms 42*a* and 42*b*) with respect to the roll body Rb. Further, the roll bodies Ra1, Ra2, Rb1, and Rb2 are collectively referred to as the roll body R.

The shaft outer circumference member 421 is an annular member and is configured to connect to the rotation support section 423 and configured to attach to the shaft member 41. The shaft outer circumference member 421 includes a fastening mechanism 4211 configured to be inwardly in contact with the shaft member 41 and fixed on the outer circumference of the shaft member 41 when tightened with a screw. That is, a fixation position of the shaft outer circumference member 421 relative to the shaft member 41 is variable. The fastening mechanism 42121 can be loosened and tightened such that the shaft outer circumference member 421 can be moved relative to the shaft member 41.

The core supporting member 422*a* is an annular member that is inwardly in contact with and fits on the core S of the roll body Ra at each end of the roll body Ra. By way of example, the inner periphery of the core supporting members 422*a* is connected to the rotation support section 423. The core supporting members 422*a* are paired to hold the core S of the roll body Ra on both ends. A flange 4221 is provided on the core supporting member 422*a* to prevent the roll body Ra from being displaced in the X axis direction. The flange 4221 has an outer diameter larger than an outer diameter of the core S of the roll body Ra, and is provided with a rack (teeth) 4222 which extends radially on the outer circumference of the side surface on the +X side. The core supporting member 42*a* may be inserted into the core until one side of the flange 4221 contacts the roll body.

The rotation support section 423 may include a ball bearing composed of balls 4231, an inner ring 4232, an outer ring 4233, and the like, and is configured such that the inner ring 4232 is connected (fixed) to the shaft outer circumference member 421, and the outer ring 4233 is connected (fixed) to the core supporting member 422*a*. That is, the rotation support section 423 connects the shaft outer circumference member 421 and the core supporting member 422*a*, and supports the core supporting member 422*a* to be rotatable about the shaft member 41 relative to the shaft outer circumference member 421. Thus, the roll body can rotate relative to the shaft member 41.

The rotation driving section 43 includes a driving section that causes the core supporting member 422*a* to rotate relative to the shaft outer circumference member 421 about the shaft member 41. The rotation driving section 43 is disposed on at least one of a pair of the support mechanism 42*a* that supports the roll body Ra. The rotation driving section 43 may include a gear 431, a motor 432 that rotates the gear 431, and the like. The gear 431 is disposed to mesh with the rack 4222 (teeth) on the flange 4221. As the motor 432 rotates, the gear 431 rotates the core supporting member 422*a* (and thus the roll body Ra) about the shaft member 41. More specifically in one example, the gear 431 may rotate the core supporting member 422*a* about the shaft member 41 relative to the shaft outer circumference member 421. The motor 432 is rotated by controlling the control unit 100 (see FIG. 2).

The shaft supporting section 44 is a support block that supports each end of the shaft member 41. As shown in FIGS. 1 to 4, the shaft supporting section 44 is supported by the guide shafts 45, and slidable on the guide shafts 45 and movable in the extending direction of the guide shaft 45. Further, the shaft supporting section 44 may include a fixation screw that permits and limits the sliding of the shaft supporting section 44. The rotation driving section 43 may be supported by the shaft supporting section 44 and may accommodate various roll papers M (roll bodies Ra and Rb) having different sizes (widths) by moving the shaft supporting section 44.

Further, the shaft supporting section 44 is configured to allow the shaft member 41 to be easily attached and detached so as to facilitate setting of the roll body Ra and detachment of the core S after completion of feeding-out of the roll paper M in the feed-out section 40 and facilitate setting of the core S for winding the roll paper M and detachment of the roll body Rb after completion of taking-up of the roll paper M in the take-up section 80. Specifically, as shown in FIGS. 1 and 2, the shaft supporting section 44 may include an upper block 441 and a lower block 442 so that the shaft member 41 can be held from above and below by the upper block 441, which can be fixed to the lower block 442, and the lower block 442, and can be fixed thereto. The shaft member 41 can be attached and detached by attaching and detaching the upper block 441 to and from the lower block 442 that is supported by the guide shaft 45.

In the feed-out section 40, as shown in FIGS. 2 and 3, two guide shafts 45 are provided. The guide shafts 45 extend in the X axis direction. Both end regions of the guide shafts 45 are supported by the extended sections 34 of the housing support section 30. Further, in the take-up section 80, as shown in FIGS. 2 and 4, two guide shafts 45 are provided. These guide shafts 45 extend in the X axis direction and both end regions are supported by the first legs 31 of the housing support section 30.

Figure 7:
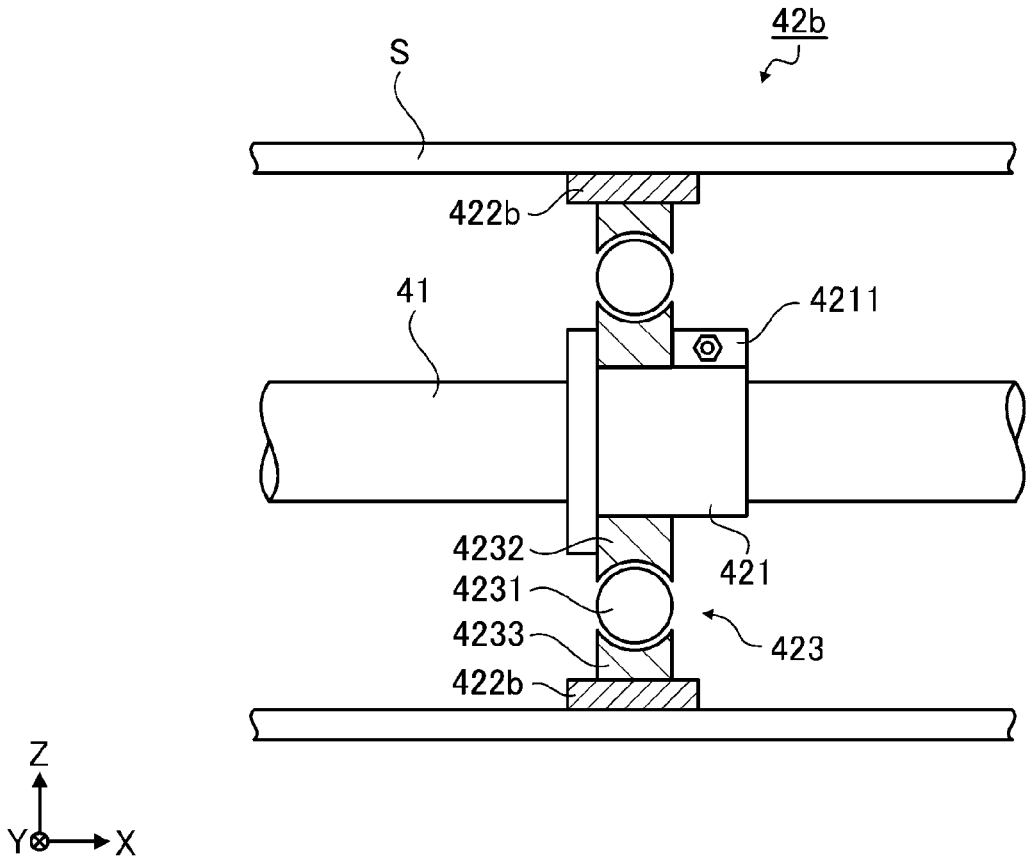
FIG. 7 is a cross-sectional view which illustrates a configuration of the support mechanism.

FIG. 7 is a cross-sectional view of a configuration of the support mechanism 42*b*. As with FIG. 5, FIG. 7 illustrates the support mechanism 42*b* as viewed from the −Y side. The support mechanism 42*b* is a support mechanism that supports the roll body Ra from inside the core S, and may include a shaft outer circumference member 421, a core supporting member 422*b*, a rotation support section 423, and the like. Unlike the core supporting member 422*a*, the core supporting member 422*b* does not have the flange 4221. That is, the outer diameter of the core supporting member 422*b* is the same as or slightly smaller than the inner diameter of the core S of the roll body Ra so that the core supporting member 422*b* can be inserted into the core S of the roll body Ra. Except for that, in one example, the configuration of the support mechanism 42*b* is the same as that of the support mechanism 42*a*. In other words, the core supporting member 422*a* includes the core supporting member 422*b* and the flange 4221. The support mechanisms 42*a* and 42*b* are collectively referred to as the support mechanism 42. Further, the core supporting members 422*a* and 422*b* are collectively referred to as the core supporting member 422.

Further, the feed-out section 40 and the take-up section 80 may include at least 5 support mechanisms 42 (support mechanisms 42*a* and 42*b*), including the shaft outer circumference member 421, the core supporting member 422 (core supporting members 422*a* and 422*b*), and the rotation support section 423 for each shaft member 41. For example, in the example shown in FIGS. 3 and 4, the feed-out section 40 and the take-up section 80 each include at least 7 support mechanisms 42 (support mechanisms 42*a* and 42*b*). The support mechanisms 42 may include one or two or more support mechanisms 42*b* that provide support from inside the core S of the roll bodies Ra and Rb, in addition to two support mechanisms 42*a* which support both ends of the roll bodies Ra and Rb.

When only one roll body is set, besides a pair of support mechanisms 42*a*, a sufficient number of support mechanisms 42*b* for the width of the roll body are provided inside the core S of the roll body at a substantially equal interval. Thus, the support mechanisms 42*b* are arranged at intervals.

As shown in FIG. 2, the medium support section 50 includes a first medium support section 51 extending from the lower rear side of the housing 20 to the inside the housing 20, a second medium support section 52 extending forward in the housing 20, and a third medium support section 53 extending from the housing 20 to the front lower side of the housing 20. Thus, the medium support section 50 has or provides a transport path that guides the roll paper M fed out from the feed-out section 40 to the take-up section 80, while supporting the roll paper M. In addition, depending on the printing method of the printing apparatus 10, when the roll paper M needs to be heated before or after printing (for example, when the roll paper M on which printing is performed needs to be dried to the required level before it is taken up by the take-up section 80), a heater for heating the roll paper M may be provided in, above, and/or below the medium support section 50.

As shown in FIG. 2, the transport unit 60 includes a driving roller 61 that rotates while being in contact with the rear surface of the roll paper M, and a driven roller 62 that rotates while being in contact with the front surface of the roll paper M. The transport unit 60 drives the driving roller 61 while the roll paper M is nipped between the driving roller 61 and the driven roller 62 so as to apply a transport force to the roll paper M to thereby transport the roll paper M fed out from the feed-out section 40 in a transport direction A. Each of the driving roller 61 and the driven roller 62 may include a plurality of rollers. In the following description, transport of the roll paper M by a predetermined distance in the transport direction A by means of the transport unit 60 is referred to as a "transport operation." During the transport operation, feeding-out of the roll paper M by the feed-out section 40 and taking-up of the roll paper M by the take-up section 80 are performed substantially at the same time by control from the control unit 100.

As shown in FIGS. 1 and 2, the print section 70 includes a print head 71 that ejects ink, a carriage 72 that holds (carries) the print head 71, and a guide shaft 73 that supports the carriage 72 and has a longitudinal direction or length in the X axis direction. The print section 70, in response to control from the control unit 100, performs an "ejection operation" for ejecting ink onto the roll paper M from the print head 71 while moving the carriage 72 in the extending direction of the guide shaft 73 (X axis direction) to thereby perform printing for one scan (one pass).

Furthermore, as shown in FIGS. 1 and 2, the take-up section 80 includes a guide bar 87 that guides the roll paper M in the transport path while the roll paper M is wound around the roll body Rb. The guide bar 87 extends in the X axis direction so as to support the roll paper M in the width direction thereof. Further, as shown in FIGS. 1 and 2, the operation section 90 is disposed on the top of the printing apparatus 10. The operation section 90 is operated by a user performing various settings of the printing apparatus 10 or instructing the execution of printing to the printing apparatus 10. Accordingly, the operation section 90 preferably includes, for example, a plurality of buttons, a liquid crystal display, and the like.

The control unit 100 may include a microcomputer having a CPU, a storage medium (memory such as ROM and RAM), and the like. The control unit 100 controls driving of the components. For example, based on the print job inputted to the printing apparatus 10 to perform printing on the roll paper M, the control unit 100 may control driving by alternately performing a transport operation and an ejection operation.

In the present embodiment, when printing is performed in parallel on two roll papers M, i.e., a roll paper M1 fed out from the roll body Ra1 and a roll paper M2 fed out from the roll body Ra2, the transport unit 60 performs the same operation to the two roll papers M1 and M2 in the transport operation. Further, when printing is performed in parallel on two roll papers M1 and M2, an ejection operation is performed by which the carriage 72 ejects ink onto the two roll papers M1 and M2 from the print head 71 mounted on the carriage 72 while moving across the width direction of the two roll papers M1 and M2 (X axis direction). That is, the transport unit 60 includes a common transport roller (the driving roller 61 and the driven roller 62) for transporting a plurality of roll papers M (roll papers M1 and M2) arranged in parallel, and the print section 70 includes the print head 71 which may be common to the plurality of roll papers M.

As described above, according to the roll body supporting device and the printing apparatus of the present embodiment, the following effects can be obtained. The roll body R is rotatably supported by the shaft outer circumference member 421, the core support member 422, and the rotation support section 423 about the base shaft, which is the shaft member 41, inserted into the core S of the roll body R. That is, the roll paper M that constitutes the roll body R is supported in a manner that allows the roll paper M to be fed out and taken up. Further, the support mechanisms 42*b*, which may include the shaft outer circumference member 421, the core support member 422*b*, the rotation support section 423, and the like, can be disposed inside the core S of the roll body R about the base shaft, which is the shaft member 41. Accordingly, even if the roll body R has a large width, a portion of the roll body R that would sag due to the weight of the roll body R itself can be supported from inside the core S. As a result, in supporting a roll body R that has a large width, the roll body R is prevented from sagging, which allows for smooth feeding-out and taking-up of the roll body R.

Further, the support mechanisms 42*b* composed of the shaft outer circumference member 421, the core support member 422*b*, the rotation support section 423, and the like can be disposed inside the core S of the roll body R about the base shaft, which is the shaft member 41. Fixation positions of the shaft outer circumference member 421, which determine positions of the support mechanisms 42*b* relative to the shaft member 41, is variable. Accordingly, the support mechanisms 42*b* can be provided at appropriate positions for supporting various roll bodies R having different sizes (widths). For example, for a roll body R that a large width, the support mechanisms 42*a* (the support mechanisms 42*b* having the flange 4221) composed of the shaft outer circumference member 421, the core support member 422*a* (core support member 422*b* having the flange 4221), the rotation support section 423, and the like are disposed on both ends of the roll body R, and a plurality of support mechanisms 42*b* composed of the shaft outer circumference member 421, the core support member 422*b*, and the rotation support section 423, and the like are disposed inside the core S at substantially equal intervals in the width direction of the core S. As a result, in supporting the roll body R that has a large width, the roll body R is prevented from sagging, which allows for smooth feeding-out and taking-up of the roll body R.

Moreover, because the rotation driving section 43 that rotates the core support member 422 is provided, feeding-out and taking-up of the roll body R can be more smoothly performed.

Further, by providing 5 sets of the support mechanisms 42, two roll bodies R can be attached on one shaft member 41 in a convenient manner. Further, roll bodies R are supported so as to independently rotate relative to the shaft member 41. Accordingly, even if the roll bodies R have different roll diameters, the roll bodies R can rotate at the same feeding-out rate or taking-up rate without any problem because they can rotate at different rotation rates even when the roll bodies are associated with or disposed on one shaft member 41.

Further, when two roll bodies R are set on one shaft member 41, 5 sets or more of the support mechanisms 42 can be provided. Accordingly, for at least one of the roll bodies R, the support mechanisms 42 can be provided at positions that support the roll bodies R from inside the core S about the base shaft, which is the shaft member 41, in the region other than both end regions of the roll body R. Accordingly, even if one of the roll bodies R has a large width, the roll body R is prevented from sagging, which allows for smooth feeding-out and taking-up of the roll body R.

Further, in the printing apparatus 10 that performs printing on the roll paper M wound in a roll shape, because the feed-out section 40 and the take-up section 80 are provided as the roll body supporting device according to the above embodiment, the roll body R can be smoothly fed out and taken up without sagging even if the roll body R has a large width. Further, because a plurality of roll bodies R can be set on one shaft member 41, a printing apparatus that performs printing on a plurality of roll bodies R can be provided with a more compact configuration. In particular, the support mechanism 42*a* that supports one roll body R at both end regions is configured by merely adding the flange 4221 to the support mechanism 42*b* that is inserted inside the core S of the roll body R. In one example, the flange 4221 or other portion may be detachably connected. Accordingly, unlike the conventional configuration, a large space outside both ends of the roll body R (X axis direction) is not require, and therefore the overall size of the printing apparatus can be reduced at least in width.

The present invention is not limited to the aforementioned embodiments, and various modifications and alterations can be made to the above embodiment. Modified examples will be described below. In the following description, the same reference numbers are given to the same components as those of the above embodiment, and the redundant description is omitted.

Modified Example 1

Figure 8:
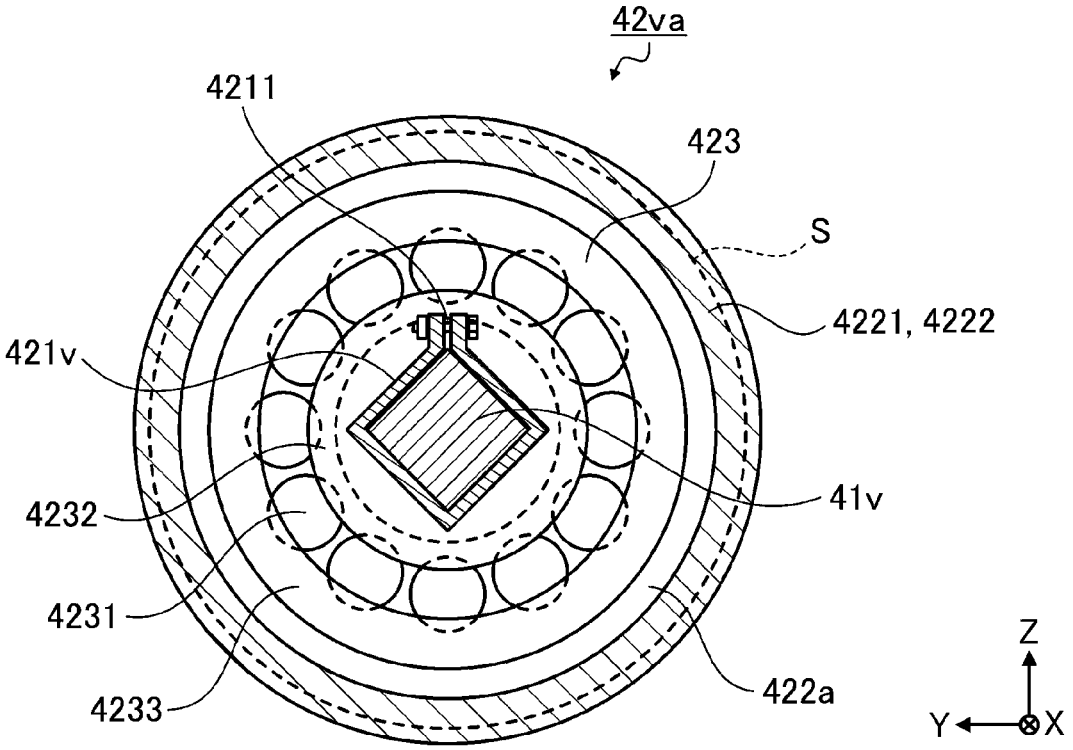
FIG. 8 is a plan view which illustrates a configuration of a support mechanism according to Modified Example 1.

FIG. 8 is a plan view that illustrates a configuration of a support mechanism 42*va* according to Modified Example 1. FIG. 8 shows the support mechanism 42*va* as viewed from the +X side. In Embodiment 1, the shaft member 41 is described as a round rod inserted into the core S of the roll body R as shown in FIG. 6. However, the invention is not limited to this configuration. Because the shaft member 41 has a configuration that does not need to rotate for feeding-out and taking-up of the roll body R, a shaft member 41*v* which is a square rod as shown in FIG. 8 may also be used. In this modified example, the shaft outer circumference member 421, which includes a fastening mechanism 4211 corresponding to the shape of the shaft member 41*v*, is provided as a shaft outer circumference member 421*v* as shown in FIG. 8. However, as long as the fixation position of the shaft outer circumference member 421*v* relative to the shaft member 41*v* is variable, that is, the shaft outer circumference member 421*v* can be movably fixed to the shaft member 41*v*, the fastening mechanism 4211 is not necessarily provided. For example, a fixation screw that permits or limits the sliding of the shaft outer circumference member 421*v* can be directly pressed against the shaft member 41*v*. Alternatively, when a sufficient stress due to the friction between the support mechanism 42*va* and the sliding section of the shaft member 41*v* can be obtained, a particular fixation means is not necessarily provided. This is because the rotation of the shaft outer circumference member 421*v* is regulated because the shaft member 41*v* is a square rod, thereby preventing a decrease in the friction coefficient between the support mechanism 42*va* and the sliding section of the shaft member 41*v* (decrease from a static friction coefficient to a kinetic friction coefficient).

Stated differently, the outer circumference members discussed herein may move relative to the length direction of the shaft member and/or rotationally with respect to the shaft member. When the shaft member is square or other shape, rotational movement of the outer circumference member relative to the shaft member can be controlled by the shape alone in some embodiments. By preventing rotational movement, a decrease in the friction coefficient between the support mechanism and the sliding section of the shaft member is prevented or minimized.

Figure 9:
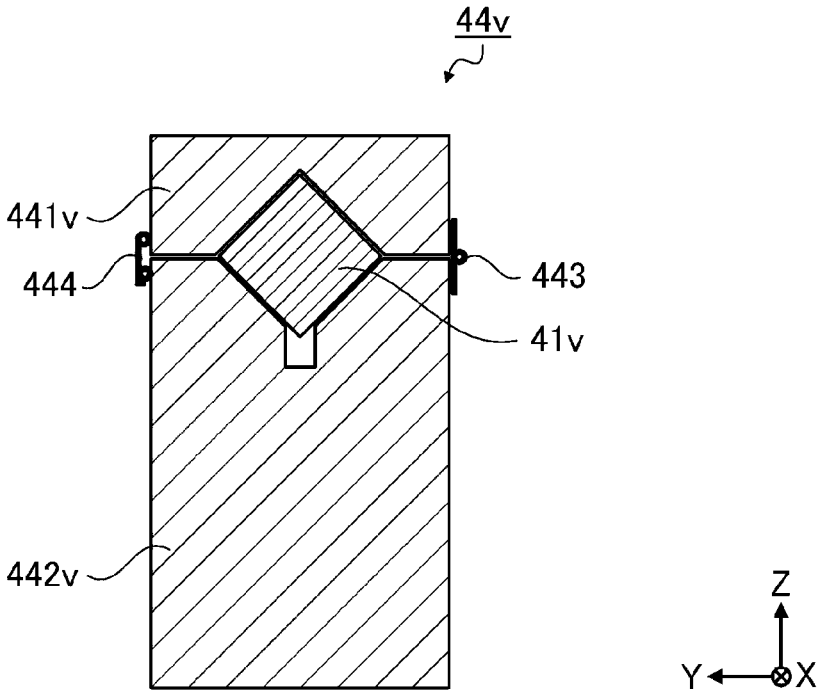
FIG. 9 is a plan view which illustrates a configuration of a shaft supporting section according to Modified Example 1.

Moreover, the shaft supporting section 44, which may have a configuration corresponding to the shape of the shaft member 41*v*, is provided as a shaft supporting section 44*v* as shown in FIG. 9. Specifically, the shaft supporting section 44*v* includes a V block that fixedly supports the shaft member 41. The shaft supporting section 44*v* may include an upper block 441*v* and a lower block 442*v* so that the shaft member 41*v* can be held from above and below by the upper block 441*v*, which can be fixed to the lower block 442*v*, and the lower block 442*v*, and can be fixed thereto. In this configuration, the lower block 442*v* is formed of the V block that supports the shaft member 41*v* from vertically under the shaft member 41*v*. The upper block 441*v* can be fixed to the lower block 442*v* by using, for example, a hinge 443 and a fitting 444 as shown in FIG. 9. This also applies to Embodiment 1.

Further, for the support mechanism 42*b* that provides support from inside the core S of the roll body R, a support mechanism 42*vb* (not shown) corresponding to the shape of the shaft member 41*v*, which is configured by eliminating the flange 4221 from the support mechanism 42*va*, is used instead of the support mechanism 42*b*.

According to this modified example, because the rotation support section 423 that rotatably supports the core support member 422 about the shaft member 41*v* relative to the shaft outer circumference member 421*v* is provided, the shaft member 41*v* does not need to be rotatable. Accordingly, the shaft member 41*v* may be provided as a square rod without any problem. By providing the shaft member 41*v* as a square rod, the shaft member 41*v* can be fixedly supported in a more simplified configuration.

Further, the shaft member 41*v* may be formed of a square rod, and the shaft supporting section 44*v* that fixedly supports the shaft member 41*v* may include the V block that fixedly supports the shaft member 41. In the configuration in which the shaft member 41*v* (square rod) is supported by the V block from vertically under the shaft member 41*v*, the shaft member 41*v* is fixed (positioned) to the V block due to the weight of the components including the roll body R (the shaft member 41*v*, the shaft outer circumference member 421*v*, the core support member 422, and the rotation support section 423). Accordingly, the configuration for fixedly supporting the shaft member 41*v* can be achieved in a more simplified manner, for example, by simply placing the shaft member 41*v* (square rod) on the V block.

What is claimed is:

1. A roll body supporting device that rotatably supports a roll body, the roll body supporting device comprising:

a shaft member configured to be inserted into a core of the roll body;

a shaft outer circumference member fixed to an outer circumference of the shaft member;

a core support member that is inwardly in contact with and fits on the core;

a rotation support section that connects the shaft outer circumference member to the core support member and supports the core support member such that the core support member is rotatable about the shaft member relative to the shaft outer circumference member, a fastening mechanism of the shaft outer circumference member being at least partially inwardly positioned relative to the core; and a shaft supporting section that supports the shaft member so that the shaft member does not rotate and is detachable from the shaft supporting section.

2. The roll body supporting device according to claim 1, wherein a fixation position of the shaft outer circumference member to the shaft member is variable.

3. The roll body supporting device according to claim 1, further comprising a rotation driving section that rotates the core support member about the shaft member relative to the shaft outer circumference member.

4. The roll body supporting device according to claim 1, wherein the shaft member comprises a square rod.

5. The roll body supporting device according to claim 4, wherein the shaft supporting section that supports the shaft member is configured to include a V block that fixedly supports the shaft member.

6. A printing apparatus comprising:

the roll body supporting device according to claim 1 that rotatably supports a roll body made of a print medium wound in a roll shape;

a transport unit that transports the print medium; and a print section that performs printing on the print medium.

7. A printing apparatus comprising:

the roll body supporting device according to claim 2 that rotatably supports a roll body made of a print medium wound in a roll shape;

a transport unit that transports the print medium; and a print section that performs printing on the print medium.

8. A printing apparatus comprising:

the roll body supporting device according to claim 3 that rotatably supports a roll body made of a print medium wound in a roll shape;

a transport unit that transports the print medium; and a print section that performs printing on the print medium.

9. A printing apparatus comprising:

the roll body supporting device according to claim 4 that rotatably supports a roll body made of a print medium wound in a roll shape;

a transport unit that transports the print medium; and a print section that performs printing on the print medium.

10. A printing apparatus comprising:

the roll body supporting device according to claim 5 that rotatably supports a roll body made of a print medium wound in a roll shape;

a transport unit that transports the print medium; and a print section that performs printing on the print medium.

11. The roll body supporting device according to claim 1, wherein the shaft supporting section includes an upper block and a lower block that allow the shaft member to be detachable from the shaft supporting section.

12. A roll body supporting device that rotatably supports a roll body, the roll body supporting device comprising:

a shaft member configured to be inserted into a core of the roll body;

a shaft outer circumference member fixed to an outer circumference of the shaft member;

a core support member that is inwardly in contact with and fits on the core;

a rotation support section that connects the shaft outer circumference member to the core support member and supports the core support member such that the core support member is rotatable about the shaft member relative to the shaft outer circumference member, wherein at least five support mechanisms, each including a shaft outer circumference member, a core support member, and a rotation support section, are provided for the shaft member.

13. A printing apparatus comprising:

the roll body supporting device according to claim 12 that rotatably supports a roll body made of a print medium wound in a roll shape;

a transport unit that transports the print medium; and a print section that performs printing on the print medium.

* * * * *